US009568242B2

(12) United States Patent
Mak

(10) Patent No.: US 9,568,242 B2
(45) **Date of Patent: *Feb. 14, 2017**

(54) ETHANE RECOVERY METHODS AND CONFIGURATIONS

(71) Applicant: Fluor Technologies Corporation, Sugar Land, TX (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/984,603

(22) Filed: Dec. 30, 2015

(65) Prior Publication Data

US 2016/0187058 A1 Jun. 30, 2016

Related U.S. Application Data

(63) Continuation of application No. 12/300,095, filed as application No. PCT/US2007/014874 on Jun. 26, 2007, now Pat. No. 9,316,433.

(Continued)

(51) Int. Cl.
*F25J 3/00* (2006.01)
*F25J 3/02* (2006.01)

(52) U.S. Cl.
CPC ..... *F25J 3/0238* (2013.01); *F25J 3/0209* (2013.01); *F25J 3/0233* (2013.01); *F25J 3/0242* (2013.01); *F25J 2200/02* (2013.01); *F25J 2200/04* (2013.01); *F25J 2200/50* (2013.01); *F25J 2200/70* (2013.01); *F25J 2200/72* (2013.01); *F25J 2205/04* (2013.01); *F25J 2215/02* (2013.01); *F25J 2215/60* (2013.01); *F25J 2215/62* (2013.01); *F25J 2220/66* (2013.01); *F25J 2240/02* (2013.01); *F25J 2245/02* (2013.01); *F25J 2270/12* (2013.01); *F25J 2270/60* (2013.01)

(58) Field of Classification Search
CPC ..... F25J 3/0209; F25J 3/0238; F25J 3/0242; F25J 3/0233; F25J 2205/04; F25J 2200/72; F25J 2200/50; F25J 2200/70; F25J 2200/78; F25J 2215/60; F25J 2215/62
USPC ..... 62/621, 618, 620, 630, 617
See application file for complete search history.

(56) References Cited

U.S. PATENT DOCUMENTS 4,061,481 A 12/1977 Campbell et al.
4,155,729 A 5/1979 Gray et al.
(Continued)

FOREIGN PATENT DOCUMENTS

WO 9859205 A2 12/1998
WO 2007008254 A1 1/2007

*Primary Examiner* — Keith Raymond
(74) *Attorney, Agent, or Firm* — Conley Rose, P.C.; Kristin Jordan Harkins

(57) ABSTRACT

Contemplated methods and configurations use a cooled ethane and CO2-containing feed gas that is expanded in a first turbo-expander and subsequently heat-exchanged to allow for relatively high expander inlet temperatures to a second turbo expander. Consequently, the relatively warm demethanizer feed from the second expander effectively removes CO2 from the ethane product and prevents carbon dioxide freezing in the demethanizer, while another portion of the heat-exchanged and expanded feed gas is further chilled and reduced in pressure to form a lean reflux for high ethane recovery.

20 Claims, 2 Drawing Sheets

Related U.S. Application Data

(60) Provisional application No. 60/817,169, filed on Jun. 27, 2006.

(56) References Cited

U.S. PATENT DOCUMENTS

| | | | | |
|---|---|---|---|---|
| 4,322,225 | A | 3/1982 | Bellinger et al. | |
| 4,657,571 | A * | 4/1987 | Gazzi | C07C 7/005 62/621 |
| 4,854,955 | A | 8/1989 | Campbell et al. | |
| 4,895,584 | A | 1/1990 | Buck et al. | |
| 5,568,737 | A | 10/1996 | Campbell et al. | |
| 5,953,935 | A | 9/1999 | Sorensen | |
| 6,116,050 | A | 9/2000 | Yao et al. | |
| 6,182,469 | B1 | 2/2001 | Campbell et al. | |
| 6,237,365 | B1 | 5/2001 | Trebble | |
| 7,051,553 | B2 | 5/2006 | Mak et al. | |
| 7,107,788 | B2 | 9/2006 | Patel et al. | |
| 7,713,497 | B2 | 5/2010 | Mak | |
| 9,316,433 | B2 * | 4/2016 | Mak | F25J 3/0209 |
| 2003/0029190 | A1 * | 2/2003 | Trebble | F25J 3/0209 62/620 |
| 2003/0177786 | A1 | 9/2003 | O'Brien | |
| 2004/0206112 | A1 | 10/2004 | Mak | |
| 2004/0237580 | A1 | 12/2004 | Mak | |
| 2005/0255012 | A1 | 11/2005 | Mak | |
| 2009/0277219 | A1 * | 11/2009 | Mak | F17C 5/06 62/620 |

* cited by examiner

ETHANE RECOVERY METHODS AND CONFIGURATIONS

This application is a continuation application of, and claims priority to, U.S. patent application Ser. No. 12/300,095 filed on May 4, 2009, which is a National Phase of PCT/US2007/014874 filed on Jun. 26, 2007, which is an International Patent application and claims priority to U.S. provisional application with the Ser. No. 60/817,169, which was filed Jun. 27, 2006.

FIELD OF THE INVENTION

The field of the invention is gas processing, and especially as it relates to natural gas processing for ethane recovery.

BACKGROUND OF THE INVENTION

Various expansion processes are known for hydrocarbon liquids recovery, especially in the recovery of ethane and propane from high pressure feed gas. Most of the conventional processes require propane refrigeration for feed gas chilling and/or reflux condensing in the demethanizer and/or demethanizer, and where feed gas pressure is low or contains significant quantity of propane and heavier components, demand for propane refrigeration is often substantial, adding significant expense to the NGL recovery process.

To reduce external propane refrigeration requirements, the feed gas can be cooled and partially condensed by heat exchange with the demethanizer overhead vapor, side reboilers, and supplemental external propane refrigeration. The so formed liquid portion of the feed gas is then separated from the vapor portion, which is split in many instances into two portions. One portion is further chilled and fed to the upper section of the demethanizer while the other portion is letdown in pressure in a single turbo-expander and fed to the mid section of the demethanizer. While such configurations are often economical and effective for feed gas with relatively high $C_3$+ (e.g., greater than 3 mol %) content, and feed gas pressure of about 1000 psig or less, they are generally not energy efficient for low $C_3$+ content (e.g., equal or less than 3 mol %, and more typically less than 1 mol %), and particularly where the feed gas has a relatively high pressure (e.g. 1400 psig and higher).

Unfortunately, in many known expander processes, residue gas from the fractionation column still contains significant amounts of ethane and propane that could be recovered if chilled to an even lower temperature, or subjected to another rectification stage. Most commonly, lower temperatures can be achieved by high expansion ratios across the turbo-expander. Alternatively, or additionally, where a relatively high feed gas pressure is present (e.g., 1600 psig and higher), the demethanizer column pressure could theoretically be increased to thereby reduce residue gas compression horsepower and lower the overall energy consumption. However, the increase in demethanizer pressure is typically limited to between 450 psig to 550 psig as higher column pressure will decrease the relative volatilities between the methane and ethane components, making fractionation difficult, if not even impossible. Consequently, excess cooling is generated by the turbo-expansion from most high pressure feed gases, which heretofore known processes cannot fully utilize.

Exemplary NGL recovery plants with a turbo-expander, feed gas chiller, separators, and a refluxed demethanizer are described, for example, in U.S. Pat. No. 4,854,955 to Campbell et al. Here, a configuration is employed for ethane recovery with turbo-expansion, in which the demethanizer column overhead vapor is cooled and condensed by an overhead exchanger using refrigeration generated from feed gas chilling. Such additional cooling step condenses most of the ethane and heavier components from the demethanizer overhead, which is later recovered in a separator and returned to the column as reflux. Unfortunately, high ethane recovery is typically limited to 80% to 90%, as $C_2$ recovery is frequently limited by $CO_2$ freezing in the demethanizer. Therefore, the excess chilling produced from the high pressure turbo-expander cannot be utilized for high ethane recovery, and must be rejected elsewhere. However, propane refrigeration is typically required in refluxing the deethanizer in such configurations which consumes significant amounts of energy. Therefore, and with respect to feed gas having relatively high pressure and low propane and heavier content, all or almost all of the known processes fail to utilize potential energy of the feed gas.

NGL recovery processes that include $CO_2$ removal in the NGL fractionation column are taught by Campbell et al. in U.S. Pat. No. 6,182,469. Here, a portion of the liquid in the top trays is withdrawn, heated, and returned to the lower section of the demethanizer for $CO_2$ removal. While such configurations can remove undesirable $CO_2$ to at least some degree, NGL fractionation efficiency is reduced, and additional fractionation trays, healing and cooling duties must be added for the extra processing steps. At the current economic conditions, such additional expenditures cannot be justified with the so realized marginal increase in ethane recovery. Still further, such systems are generally designed for feed gas pressure of 1100 psig or lower, and are not suitable for high feed gas pressure (e.g. 1600 psig or higher). Further known configurations with similar difficulties are described in U.S. Pat. Nos. 4,155,729, 4,322,225, 4,895,584, 7,107,788, 4,061,481, and WO2007/008254.

Thus, while numerous attempts have been made to improve the efficiency and economy of processes for separating and recovering ethane and heavier natural gas liquids from natural gas and other sources, all or almost all of them suffer from one or more disadvantages. Most significantly, heretofore known configurations and methods fail to exploit the economic benefit of high feed gas pressure and the cooling potential of the demethanizer, especially when the feed gas contains a relatively low $C_3$ and heavier content. Therefore, there is still a need to provide improved methods and configurations for natural gas liquids recovery.

SUMMARY OF THE INVENTION

The present invention is directed to configurations and methods in which a relatively high pressure of a CO2-containing feed gas with relatively low C3+ content is employed to provide cooling and energy for recompression while at the same time maximizing ethane recovery. Most preferably, the feed gas is cooled and expanded in at least two stages, wherein a vapor portion of the feed is fed to the second expander at relatively high temperature to thus prevent CO2 freezing in the demethanizer, and wherein another vapor portion is subcooled to thereby form a lean reflux.

In one aspect of the inventive subject matter, a gas processing plant (most preferably for processing a CO2-containing feed gas having a relatively low C3+ content) includes a first heat exchanger, a first turboexpander, and a second heat exchanger, that are coupled to each other in series and configured to cool and expand a feed gas to a pressure that is above the demethanizer operating pressure (e.g., between 1000 psig and 1400 psig). A separator is fluidly coupled to the second heat exchanger and configured to separate the cooled and expanded feed gas into a liquid phase and a vapor phase, and a second turboexpander is coupled to the separator and configured to expand one portion of the vapor phase to the demethanizer pressure while a third heat exchanger and a pressure reduction device that are configured to receive and condense another portion of the vapor phase to thereby form a reflux to the demethanizer.

Therefore, and viewed from a different perspective, a method of separating ethane from an ethane-containing gas comprises a step of cooling and expanding the feed gas from a feed gas pressure to a pressure above a demethanizer operating pressure, and a further step of separating a vapor phase from the cooled and expanded feed gas. One portion of the superheated vapor phase is expanded in a turboexpander to the operating pressure of the demethanizer, while another portion of the vapor phase is cooled, liquefied, and expanded to thereby generate a reflux that is fed to the demethanizer.

Most preferably, the first and second heat exchangers are thermally coupled to the demethanizer to provide at least part of a recoiling duty to the demethanizer, and/or a side reboiler is thermally coupled to the deethanizer overhead condenser and/or residue gas heat exchanger to provide refrigeration/reboiling requirements to the system. To recover at least some of the energy in the high-pressure feed gas, it is preferred that the first turboexpander is mechanically coupled to a residue gas compressor (or power generator). Typically, the feed gas is provided by a source (e.g., gas field, regasification plant for LNG) at a pressure of at least 1500 psig, and/or the feed gas comprises at least 0.5 mol % CO2 and less than 3 mol % C3+ components.

It is still further generally preferred that first heat exchanger, the first turboexpander, and the second heat exchanger are configured to cool the feed gas to a temperature above −10° F. and/or that the second turboexpander is configured such that the expanded portion of the vapor phase (i.e., the demethanizer feed) has a temperature between −75° F. and −85° F. and a pressure between 400 psig and 550 psig. Moreover, it is generally preferred that the third heat exchanger and the pressure reduction device are configured to condense the vapor phase at a temperature of equal or less than −130° F. to provide the demethanizer reflux.

Various objects, features, aspects and advantages of the present invention will become more apparent from the following detailed description of preferred embodiments of the invention, along with the accompanying drawing.

DETAILED DESCRIPTION

The inventor has discovered that various high pressure hydrocarbon feed gases (e.g. at least 1400 psig, and more preferably at least 1600 psig, and even higher) can be processed in configurations and methods that include two stages of turbo-expansion that will significantly contribute to the cooling requirements of a downstream demethanizer and deethanizer. The feed gas in preferred aspects comprises CO2 in an amount of at least 0.5 mol %, and more typically at least 1-2 mol %, and has a relatively low C3+ (i.e., C3 and higher) content that is typically equal or less than 3 mol %.

In most of contemplated configurations and methods, ethane recovery of at least 70% to 95% is achieved while refrigeration and energy requirements are dramatically reduced. Moreover, in especially preferred configurations and methods, the demethanizer reboiler duty is provided by the feed gas heat content, and expansion of the feed gas provides refrigeration content in the reflux and demethanizer feed, which is also used to condense the deethanizer overhead product via a side draw from the demethanizer and/or to reduce recompressor inlet temperature.

It should be especially appreciated that the feed gas in contemplated configurations and methods is expanded in the first turbo-expander and subsequently heat-exchanged such that the expander inlet temperature to the second turbo expander is significantly higher than in typical heretofore known configurations. Such relatively warm inlet temperature results in a feed to the demethanizer that helps remove carbon dioxide from the ethane product and prevents carbon dioxide freezing, while the relatively cold temperature of the reflux stream and column pressure of about 450 psig assists in effective separation of ethane from heavier components. Where desired, the residue gas is combined with the $C_3$ and heavier components extracted from the feed gas while the ethane is used separately or sold as commodity.

Figure 1:
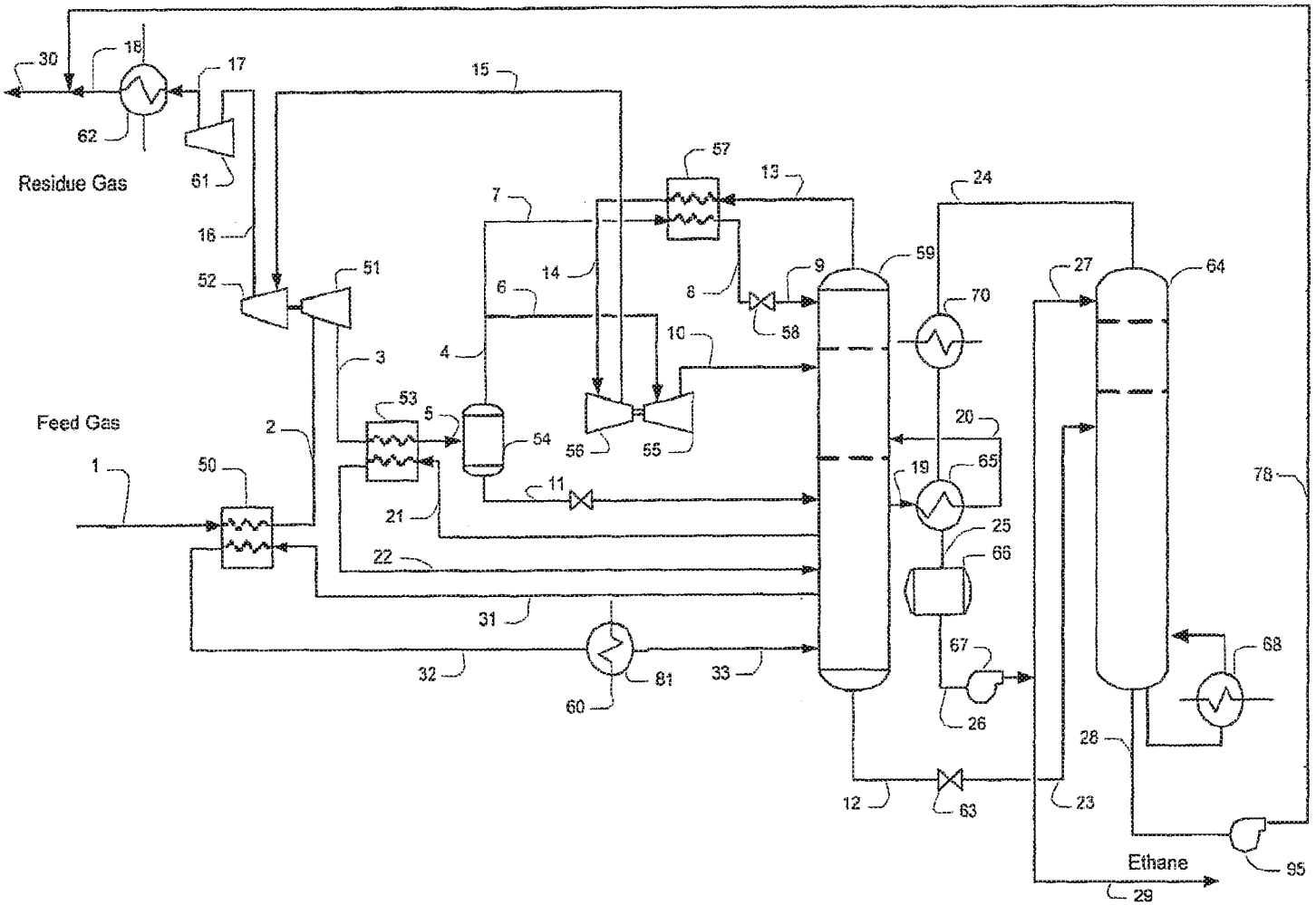
FIG. 1 is a schematic diagram of one exemplary ethane recovery configuration according to the inventive subject matter.

In one especially preferred aspect of the inventive subject matter, an exemplary plant as shown in FIG. 1 includes a demethanizer that is fluidly coupled to two turbo-expanders that operate in series, wherein the feed gas is chilled upstream and downstream of the first turbo-expander. Most preferably, chilling and expansion in these devices is adjusted to maintain the temperature to the second expander suction at 0 to 30° F. This relatively high expander temperature is utilized for stripping $CO_2$ in the demethanizer while simultaneously avoiding $CO_2$ freezing in the column. It should further be appreciated that additional power generated with the twin turbo-expanders can be used to reduce the residue gas compression energy requirements, and/or can be used to reduce or even eliminate propane refrigeration. Furthermore, it should be recognized that the demethanizer side reboiler in preferred plants is heated by providing condensation duty for the reflux to the deethanizer, which still further reduces propane refrigeration requirement. Such use will also help prevent $CO_2$ freezing by stripping $CO_2$ in the demethanizer from the NGL.

With further reference to FIG. 1, feed gas stream 1, at 85° F. and 1700 psig is chilled in first exchanger 50 to about 40° F. to 70° F., forming chilled feed gas stream 2 and heated stream 32. Refrigeration content for exchanger 50 is provided by the demethanizer reboiler feed stream 31. Thus, at least a portion of the reboiler heating duty for stripping undesirable components in the demethanizer bottoms stream 12 is provided by the feed gas. Optionally, healer 81 can be used to further heat stream 32 to a higher temperature forming stream 33, which supplements the demethanizer reboiler heating requirement by utilizing heat from the residue compressor discharge or hot oil stream 60. Stream 2 is expanded across the first turboexpander 51 to a lower pressure, typically 1000 psig to 1400 psig, forming stream 3, which is further cooled in second exchanger 53 to about −10° F. to 30° F. forming stream 5. Refrigeration content is provided by upper side reboiler stream 21, thereby forming heated stream 22. When processing a rich gas, the condensate is separated in separator 54 into liquid stream 11 and vapor stream 4.

Stream 11 is let down in pressure and fed to the lower section of the demethanizer 59 while the vapor stream 4 is split into two portions, stream 6 and 7, typically at a split ratio of stream 4 to 7 ranging from 0.3 to 0.6. It should be appreciated that the split ratio of the chilled gas can be varied, preferably together with the expander inlet temperature for a desired ethane recovery and $CO_2$ removal. Increasing the flow to the demethanizer overhead exchanger increases the reflux rate, resulting in a higher ethane recovery. Therefore, the co-absorbed $CO_2$ must be removed by higher temperature and/or higher flow of the expander to avoid $CO_2$ freezing. As used herein, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig.

Stream 6 is expanded in the second turboexpander 55 to about 400 psig to 550 psig, forming stream 10, typically having a temperature of about −80− F. Stream 10 is fed to the top section of demethanizer 59. Stream 7 is chilled in the demethanizer overhead exchanger 57 to stream 8 at about −140° F., using the refrigeration content of the demethanizer overhead vapor stream 13, which is further reduced in pressure in JT valve 58. So formed stream 9 is fed to the top of the demethanizer 59 as subcooled lean reflux. While it is generally preferred that stream 8 is expanded in a Joule-Thomson valve, alternative known expansion devices are also considered suitable for use herein and include power recovery turbines and expansion nozzles.

It should be noted that the demethanizer in preferred configurations is reboiled with the heat content from (a) the feed gas, (b) the compressed residue gas, and (c) the deethanizer reflux condenser 65 to limit the methane content in the bottom product at 2 wt % or less. Still further, contemplated configurations and methods also produce an overhead vapor stream 13 at about −135° F. and 400 psig to 550 psig, and a bottom stream 12 at 50° F. to 70° F. and 405 psig to 555 psig. The overhead vapor 13 is preferably used to supply feed gas cooling in the exchanger 57 to form stream 14 and is subsequently compressed by first stage re-compressor 56 (driven by second turboexpander 55) forming stream 15 at about 45° F. and about 600 psig. Compressed stream 15 is further compressed to stream 16 by second re-compressor 52 driven by first turboexpander 51 to about 750 psig, and finally by residue gas compressor 61 to thus form stream 17 at 1600 psig or higher pressure. The heat content in the compressed residue gas is preferably utilized to supply at least a portion of the reboiler duties in the demethanizer reboiler 81 and deethanizer reboiler 68 (e.g., via exchanger 62). The compressed and cooled residue gas stream 18 is then optionally mixed with propane stream 78 forming stream 30 supplying the gas pipeline. Propane produced from the deethanizer bottoms advantageously increases the heating value content, which is particularly desirable where propane and heavier components are valued as natural gas and where liquid propane sales are not readily available.

The demethanizer bottoms 12 is letdown in pressure to about 300 psig to 400 psig in JT valve 63 and fed as stream 23 to the mid section of the deethanizer 64 that produces an ethane overhead stream 24 and a C3+ (propane and heavier) bottoms 28. The deethanizer overhead vapor 24 is optionally cooled by propane refrigeration in exchanger 70 and exchanger 65 where a side-draw from the demethanizer stream 19, is heated from about −50° F. to about 10° F. forming stream 20, while the deethanizer overhead vapor is condensed at about 20° F., forming stream 25. The deethanizer overhead stream 25 is totally condensed, separated in separator 66 and pumped as stream 26 by product/reflux pump 67, producing reflux stream 27 to the deethanizer and ethane liquid product stream 29. The deethanizer bottoms stream 28 containing the $C_3$ and heavier hydrocarbons is pumped by pump 95 to about 1600 psig to mix with the compressed residue gas supplying the pipeline. Alternatively, the C3+ components may also be withdrawn to storage or sold as a commodity.

Figure 2:
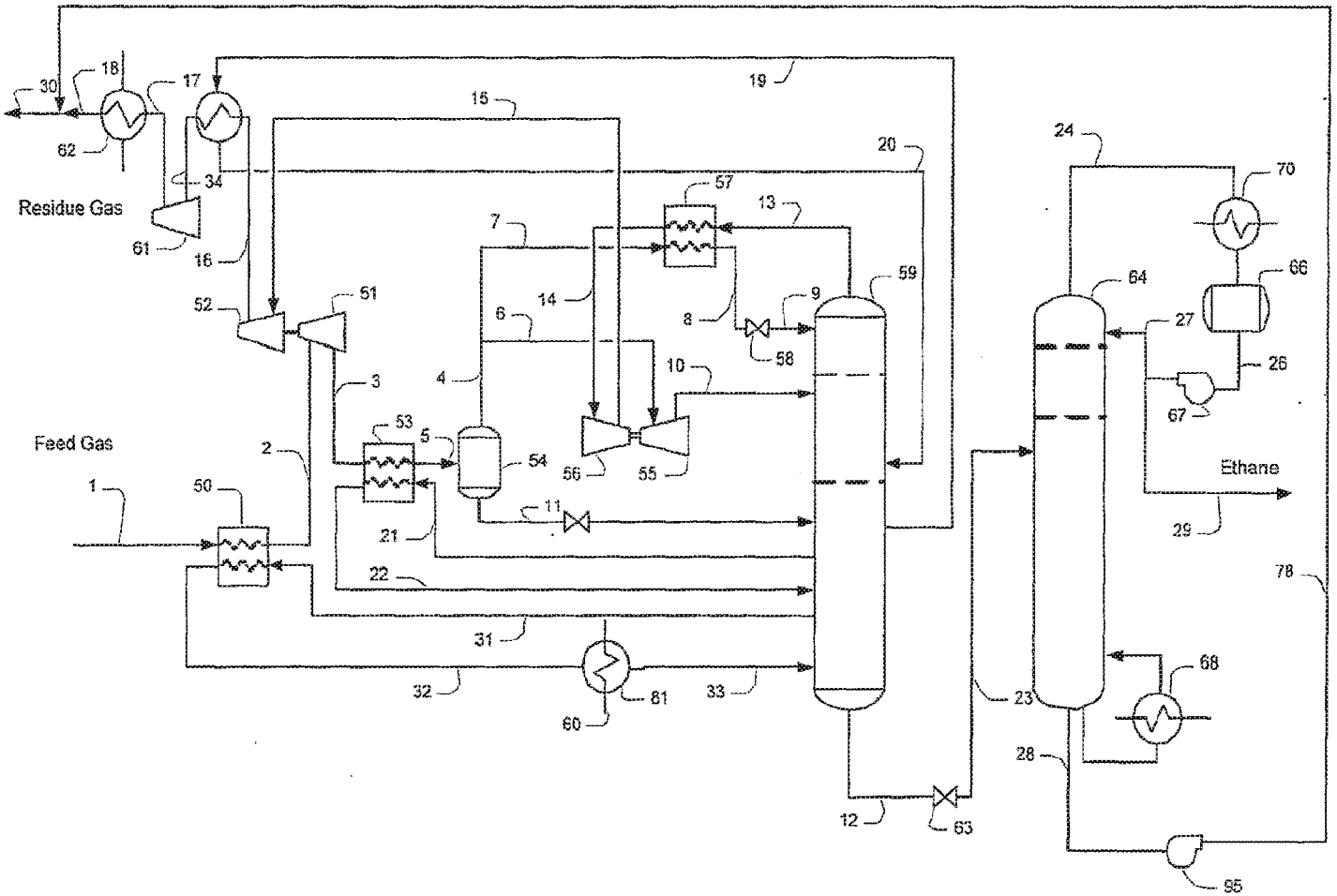
FIG. 2 is a schematic diagram of another exemplary ethane recovery configuration according to the inventive subject matter.

FIG. 2 shows an alternative configuration that includes the use of the demethanizer side reboiler for chilling the residue gas compressor suction to thereby reduce the residue gas compression horsepower. In this configuration, stream 19 at about −50° F. is withdrawn from the upper section of the demethanizer to cool the residue gas compressor suction stream 16 from 90° F. to about 20° F. forming stream 34. The heated side-draw stream 20 is returned to the demethanizer for stripping the undesirable components. Deethanizer overhead stream 24 is then condensed by exchanger 70 and the condensate is separated in separator 66 to form ethane stream 26. Stream 26 is pumped to deethanizer pressure by pump 67 and split to provide lean reflux 27 to the deethanizer 64 and ethane product stream 29. The remaining components and operation of this configuration are similar to the configuration and use in FIG. 1, and with respect to the remaining components and numbering, the same numerals and considerations as in FIG. 1 above apply.

Most preferably, the feed gas hydrocarbon has a pressure of about at least 1200 psig, more preferably at least 1400 psig, and most preferably at least 1600 psig, and will have a relatively high $CO_2$ content (e.g., at least 0.2 mol %, more typically at least 0.5 mol %, and most typically al least 1.0 mol %). Furthermore, especially suitable feed gases are preferably substantially depleted of C3+ components (i.e., total C3+ content of less than 3 mol %, more preferably less than 2 mol %, and most preferably less than 1 mol %). For example, a typical feed gas will comprise 0.5% $N_2$, 0.7% $CO_2$, 90.5% $C_1$, 5.9% $C_2$, 1.7% $C_3$, and 0.7% $C_4$+.

Most typically, the feed gas is chilled in a first exchanger to a temperature of about 40 to 70° F. with refrigeration content of the demethanizer bottom reboiler and then expanded in the first turboexpander to a pressure of about 1100 to about 1400 psig. The power generation from the first turboexpansion is preferably utilized to drive the second stage of the residue gas re-compressor. The so partially expanded and chilled feed gas is then further cooled by the demethanizer side reboiler(s) to a point that maintains the suction temperature of the gas to the expander in a superheated state (i.e., without liquid formation). It should be appreciated that such high temperature (e.g. 0° F. to 30° F.) is advantageous in stripping undesirable CO2 in the demethanizer while increasing the power output from the expander, which in turn reduces the residue gas compression horsepower. Viewed from another perspective, contemplated methods and configurations may be used to remove CO2 from the NGL to low levels and to reduce energy consumption of the downstream CO2 removal system.

In contrast, the feed gas in heretofore known configurations is typically cooled to a low temperature (typically 0° F. to −50° F.) and split into two portions that are separately fed to the demethanizer overhead exchanger (sub-cooler) and the expander for further cooling (e.g., to temperatures below −120 to −160° F.). Thus, it should be noted that the efficiency of these known configurations arises, among other factors, from the low temperatures that reduce the expander power output, subsequently requiring a higher residue gas compression horsepower. Moreover, low temperatures at the expander suction/outlet also condense CO2 vapor inside the demethanizer, which leads to increased CO2 content in the NGL product. Viewed from another perspective, known configurations fail to reduce the CO2 content in NGL, and further require significant energy without increasing ethane recovery.

Thus, it should be especially recognized that in contemplated configurations a portion of feed gas is chilled to supply a subcooled liquid as reflux, while another portion is used as a relatively warm expander inlet feed to control CO2 freezing in the column. Furthermore, the cooling requirements for both columns are at least in part provided by refrigeration content that is gained from the two stage turboexpansion. With respect to the ethane recovery, it is contemplated that configurations according to the inventive subject matter provide at least 70%, more typically at least 80%, and most typically at least 95% recovery when residue gas recycle to the demethanizer is used (not shown in the figures), while C3+ recovery will be at least 90% (preferably re-injected to the sales gas to enhance the heating value of the residue gas).

Additionally, or alternatively, it is contemplated that at least a portion of the residue gas compressor discharge can be cooled to supply the reboiler duties of the demethanizer and deethanizer. With respect to the heat exchanger configurations, it should be recognized that the use of side reboilers to supply feed gas and residue gas cooling and deethanizer reflux condenser duty will minimize total power requirement for ethane recovery. Therefore, propane refrigeration can be minimized or even eliminated, which affords significant cost savings compared to known processes. Consequently, it should be noted that in the use of two turboexpanders coupled to the demethanizer and deethanizer operation allows stripping of CO2, reducing CO2 freezing, and eliminating or minimizing propane refrigeration in the ethane recovery process, which in turn lowers power consumption and improves the ethane recovery. Further aspects and contemplations suitable for the present inventive subject matter are described in our International patent application with the serial number PCT/US04/32788 and U.S. Pat. No. 7,051,553, both of which are incorporated by reference herein.

Thus, specific embodiments and applications of ethane recovery configurations and methods therefor have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A gas processing plant for processing a feed gas, comprising:

a feed gas source configured to provide a feed gas comprising at least 0.5 mol % $CO_2$ and less than 3 mol % $C_{3+}$ components;

a first heat exchanger, a first turboexpander, and a second heat exchanger, coupled to each other in series and configured to cool and expand the feed gas;

a separator fluidly coupled to the second heat exchanger and configured to separate the cooled and expanded feed gas into a liquid phase and a vapor phase;

a second turboexpander coupled to the separator and configured to expand a first portion of the vapor phase to thereby produce an expanded first portion, and to deliver the expanded first portion to a demethanizer to thereby strip $CO_2$ from an ethane product in the demethanizer;

a third heat exchanger and a pressure reduction device that are coupled to each other and configured to receive and condense a second portion of the vapor phase to thereby form a reflux to the demethanizer; and a fourth heat exchanger configured to use a deethanizer overhead product from a deethanizer or a demethanizer overhead product as a heat source to heat a side draw of the demethanizer to a temperature suitable to strip $CO_2$ from the ethane product in the demethanizer.

2. The plant of claim 1, wherein the first and second heat exchangers are thermally coupled to the demethanizer to provide at least part of a reboiling duty to the demethanizer.

3. The plant of claim 1, wherein the first turboexpander is mechanically coupled to a residue gas compressor.

4. The plant of claim 1, wherein the feed gas source is configured to provide feed gas at a pressure of at least 1500 psig.

5. The plant of claim 1, wherein the feed gas comprises at least 1.0 mol % $CO_2$ and less than 3 mol % $C_{3+}$ components.

6. The plant of claim 1, wherein the first turboexpander is configured to expand the feed gas to a pressure between 1000 psig and 1400 psig above a demethanizer operating pressure.

7. The plant of claim 1, wherein the first heat exchanger, the first turboexpander, and the second heat exchanger are configured to cool the feed gas so that the first portion of the vapor phase has a temperature of between 0° F. to 30° F.

8. The plant of claim 1, wherein the second turboexpander is configured such that the expanded first portion of the vapor phase has a temperature between −75° F. and −85° F. and a pressure between 400 psig and 550 psig.

9. The plant of claim 1, wherein the third heat exchanger and the pressure reduction device are configured to condense the second portion of the vapor phase at a temperature of equal or less than −130° F.

10. The plant of claim 1, further comprising a fifth heat exchanger configured to provide cooling to the deethanizer overhead product, and wherein the fourth heat exchanger or the fifth heat exchanger is configured to (i) receive the overhead deethanizer product and (ii) condense the deethanizer overhead product to thereby provide a reflux to the deethanizer.

11. A method of separating ethane from a feed gas, comprising:

providing from a feed gas source the feed gas comprising at least 0.5 mol % $CO_2$ and less than 3 mol % $C_{3+}$ components;

cooling and expanding the feed gas to thereby produce a cooled and expanded teed gas;

separating a vapor phase from the cooled and expanded feed gas;

expanding a first portion of the vapor phase in a turboexpander to thereby produce an expanded first portion;

feeding the expanded first portion of the vapor phase to a demethanizer to thereby strip $CO_2$ from an ethane product in the demethanizer;

cooling and expanding a second portion of the vapor phase to generate a reflux, and feeding the reflux to the demethanizer; and heating a side draw of the demethanizer with a deethanizer overhead product from a deethanizer or a demethanizer overhead product to a temperature suitable for stripping of $CO_2$ from the ethane product in the demethanizer.

12. The method of claim 11, wherein the step of expanding the feed gas is performed in a further turboexpander that is mechanically coupled to a compressor.

13. The method of claim 11, wherein the step of cooling the feed gas is performed using a heat exchanger that is configured to provide reboiling heat to the demethanizer.

14. The method of claim 11, wherein the feed gas has a pressure of at least 1500 psig.

15. The method of claim 11, wherein the feed gas comprises at least 1.0 mol % $CO_2$ and less than 3 mol % $C_{3+}$ components.

16. The method of claim 11, wherein the cooled and expanded feed gas has a pressure between 1000 psig and 1400 psig above a demethanizer operating pressure.

17. The method of claim 11, wherein the first portion of the vapor phase has a temperature of between 0° F. to 30° F.

18. The method of claim 11, wherein the expanded first portion of the vapor phase has a temperature between −75° F. and −85° F. and a pressure between 400 psig and 550 psig.

19. The method of claim 11, wherein the second portion of the vapor phase is cooled such that the reflux has a temperature of equal or less than 430° F.

20. The method of claim 11, further comprising cooling the deethanizer overhead product to generate a condensed deethanizer overhead product, and feeding a portion of the condensed overhead product to the deethanizer as a deethanizer reflux.

* * * * *